US008590082B2

(12) United States Patent
Mantzis

(10) Patent No.: US 8,590,082 B2
(45) Date of Patent: Nov. 26, 2013

(54) MATTRESS CORE

(75) Inventor: George Mantzis, Campbellfield (AU)

(73) Assignee: Mantzis Holdings Pty Ltd., Melbourne, Victoria (AU)

( * ) Notice: Subject to any disclaimer, the term of this patent is extended or adjusted under 35 U.S.C. 154(b) by 44 days.

(21) Appl. No.: 13/096,146

(22) Filed: Apr. 28, 2011

(65) Prior Publication Data

US 2011/0265266 A1 Nov. 3, 2011

(30) Foreign Application Priority Data

Apr. 28, 2010 (AU) ..... 2010901796

(51) Int. Cl.

| | |
|---|---|
| ***A47C 23/04*** | (2006.01) |
| ***A47C 23/02*** | (2006.01) |
| ***A47C 17/00*** | (2006.01) |
| ***B68G 5/00*** | (2006.01) |

(52) U.S. Cl.

USPC ..... 5/720; 5/269; 5/655.8; 5/716; 5/721; 5/739

(58) Field of Classification Search

USPC ..... 5/269, 655.8, 716, 720, 721, 739

See application file for complete search history.

(56) References Cited

U.S. PATENT DOCUMENTS

| | | | | |
|---|---|---|---|---|
| 1,741,847 | A * | 12/1929 | Kaspar | 5/655.8 |
| 2,461,062 | A * | 2/1949 | Kane | 5/720 |
| 4,234,983 | A | 11/1980 | Stumpf | |
| 4,679,266 | A * | 7/1987 | Kraft | 5/716 |
| 4,854,023 | A * | 8/1989 | Stumpf | 29/91 |
| 5,105,488 | A * | 4/1992 | Hutchinson et al. | 5/710 |
| 5,222,264 | A * | 6/1993 | Morry | 5/718 |
| 5,469,590 | A * | 11/1995 | Simon | 5/721 |
| 5,669,087 | A * | 9/1997 | Wells et al. | 5/269 |
| 5,699,998 | A * | 12/1997 | Zysman | 267/189 |
| 5,749,133 | A * | 5/1998 | Mauldin et al. | 29/91.1 |
| 5,803,440 | A * | 9/1998 | Wells | 267/92 |
| 5,868,383 | A * | 2/1999 | Codos | 267/80 |
| 5,987,678 | A * | 11/1999 | Ayers | 5/720 |
| 6,159,319 | A * | 12/2000 | Mossbeck | 156/182 |
| 6,175,997 | B1 * | 1/2001 | Mossbeck | 29/91 |
| 6,256,820 | B1 * | 7/2001 | Moser et al. | 5/655.8 |
| 6,315,275 | B1 * | 11/2001 | Zysman | 267/89 |
| 6,398,199 | B1 * | 6/2002 | Barber | 267/93 |
| 6,523,812 | B1 * | 2/2003 | Spinks et al. | 267/80 |
| 6,540,214 | B2 * | 4/2003 | Barber | 267/93 |
| 6,574,811 | B1 * | 6/2003 | Mossbeck | 5/655.8 |
| 6,591,436 | B2 * | 7/2003 | de Santis et al. | 5/655.8 |
| 6,668,406 | B2 * | 12/2003 | Spinks et al. | 5/655.8 |
| 6,681,428 | B2 * | 1/2004 | Wells | 5/720 |
| 6,684,435 | B1 * | 2/2004 | Wells | 5/720 |
| 6,698,166 | B2 * | 3/2004 | Zysman | 53/550 |

(Continued)

FOREIGN PATENT DOCUMENTS

| | | | | |
|---|---|---|---|---|
| WO | WO 9935081 | A1 * | 7/1999 | B68G 9/00 |
| WO | WO 2009029057 | A1 * | 3/2009 | A47C 27/06 |

*Primary Examiner* — William Kelleher
*Assistant Examiner* — Eric Kurilla
(74) *Attorney, Agent, or Firm* — Merchant & Gould P.C.

(57) ABSTRACT

A mattress core including an array of strings of pocket springs extending in parallel across the mattress core; and a fastener coupling the array of strings of pocket springs together, wherein said array of strings of pocket springs includes single strings of pocket springs and double strings of pocket springs, each double string of said double strings of pocket springs including a superior string of pocket springs and an inferior string of pocket springs.

19 Claims, 15 Drawing Sheets

(56) References Cited

U.S. PATENT DOCUMENTS

| | | | | |
|---|---|---|---|---|
| 6,813,791 | B2 * | 11/2004 | Mossbeck et al. | 5/720 |
| 6,862,763 | B2 * | 3/2005 | Mossbeck et al. | 5/655.8 |
| 6,966,091 | B2 * | 11/2005 | Barber | 5/716 |
| 6,986,182 | B2 * | 1/2006 | Mossbeck | 5/727 |
| 7,617,556 | B2 * | 11/2009 | Rensink | 5/739 |
| 7,854,031 | B2 * | 12/2010 | Rawls-Meehan | 5/719 |
| 2004/0025256 | A1 * | 2/2004 | Mossbeck | 5/655.8 |
| 2010/0139006 | A1 * | 6/2010 | Kilic | 5/720 |

* cited by examiner

MATTRESS CORE

This application claims benefit of Serial No. 2010901796, filed 28 Apr. 2010 in Australia and which application is incorporated herein by reference. To the extent appropriate, a claim of priority is made to the above disclosed application.

TECHNICAL FIELD OF THE INVENTION

This invention relates to a mattress core and to a method of manufacturing a mattress core.

BACKGROUND OF THE INVENTION

Mattress cores, for example, have previously included an array of strings individually pocketed springs. In such mattress cores, each spring coil is encased within its own fabric sack, which is usually made in the form of a pocket defined between two plies of a fabric strip connected together at intervals by transverse stitching. The two-ply strip is usually formed by folding a strip of double width upon itself along its longitudinal midline, leaving the overlapped plies along the unjoined opposite edge of the strip to be connected to each other to close the pocket after the spring is inserted.

A variety of techniques have evolved for the manufacture of pocketed springs. Some of these techniques teach the creation of the pockets within the fabric plies prior to insertion of the wire spring and others teach the insertion of the coaxially compressed wire springs between the plies of the strip and the subsequent creation of the pockets by stitching the two plies to each other along transverse lines between adjacent springs. In either technique, the pocket is closed after the insertion of the spring, usually be stitching the two plies together along a line parallel to the free edges of the plies.

U.S. Pat. No. 4,234,983 provides an example of an improved method of manufacturing a mattress core. Specifically, U.S. Pat. No. 4,234,983 teaches manufacture of an array of strings of pocket springs in which, for each string, the overlaid fabric plies are secured to each other along the transverse and longitudinal lines of attachment earlier referred to by thermal welding rather than by the use of stitching, as had conventionally been done. For each string of pocket springs, the pocket fabric is thermally weldable to itself so that the two plies of fabric of the folded strip in which the pockets are defined may be secured together without the necessity for stitching. In doing so, a stronger bond than is achieved when compared with sewing the same fabric material. At the same time, the elimination of any need for the thread and the sewing apparatus which was necessary to the manufacture of upholstery springs of this type. The utilization of thermally weldable materials provides a substantial simplification of the manufacture of superior springs. The manufacturing techniques disclosed in U.S. Pat. No. 4,234,983 are incorporated herein by way of reference.

In society, different people have different preferences when it comes to qualities in mattresses. For example, some people prefer a softer mattress and others prefer a harder mattress. It may be possible for a manufacturer to produce a soft mattress or a hard mattress. However, it is generally more difficult for a manufacturer to provide greater control over the firmness of the resultant mattress. For example, using the techniques disclosed in U.S. Pat. No. 4,234,983, a manufacturer could produce a soft mattress or a hard mattress by determining an appropriate a rate of springs for use in manufacturing the mattress core. However, U.S. Pat. No. 4,234,983 does not anticipate further techniques for controlling the firmness of the resultant mattress.

The above described problems are more pronounced when a mattress is to be shared by two people with different requirements for mattress firmness. This is particularly the case when the mattress is to be shared by a man and a woman having different body sizes, for example. In this situation, a mattress that is considered to have an adequate firmness by the larger of the two will invariably be considered too hard for the lighter of the two. It is difficult to find a single mattress that satisfies the requirements of both parties.

It is generally desirable to overcome or ameliorate one or more of the above mentioned difficulties, or at least provide a useful alternative.

SUMMARY OF THE INVENTION

In accordance with one aspect of the invention, there is provided a mattress core including:

(a) an array of strings of pocket springs extending in parallel across the mattress core; and (b) a fastener coupling the array of strings of pocket springs together, wherein said array of strings of pocket springs includes single strings of pocket springs and double strings of pocket springs, each double string of said double strings of pocket springs including a superior string of pocket springs and an inferior string of pocket springs.

Preferably, springs of each of the single strings of pocket springs have a common first rate, springs of each superior string of pocket springs have a common second rate, and springs of each inferior string of pocket springs have a common third rate.

Preferably, the first rate is less than the second rate, and the first rate is less than third rate.

Preferably, the third rate is less than the second rate.

Preferably, each double string of said double strings is arranged between a corresponding pair of said single strings of pocket springs.

In accordance with another aspect of the invention, there is provided a mattress including the above described mattress core.

In accordance with another aspect of the invention, there is provided a method of manufacturing a mattress core including the steps of:

(a) coupling a series of strings of pocket springs together with a fastener to form an array of strings of pocket springs; and (b) coupling the array of strings of pocket springs together with a fastener, wherein said array of strings of pocket springs includes single strings of pocket springs and double strings of pocket springs, each double string of said double strings of pocket springs including a superior string of pocket springs and an inferior string of pocket springs.

Preferably, the method includes the step of selecting a rate of springs of each superior string of pocket springs.

Preferably, the method includes the step of selecting a rate of springs of each inferior string of pocket springs.

Preferably, the method includes the step of selecting a rate of springs of each single string of said single strings of pocket springs.

In accordance with another aspect of the invention, there is provided a mattress core including:

(a) an array of strings of pocket springs extending in parallel across the mattress core; and (b) a fastener coupling the array of strings of pocket springs together, wherein said array of strings of pocket springs includes double strings of pocket springs, each double string of said double strings of pocket springs including a superior string of pocket springs and an inferior string of pocket springs.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
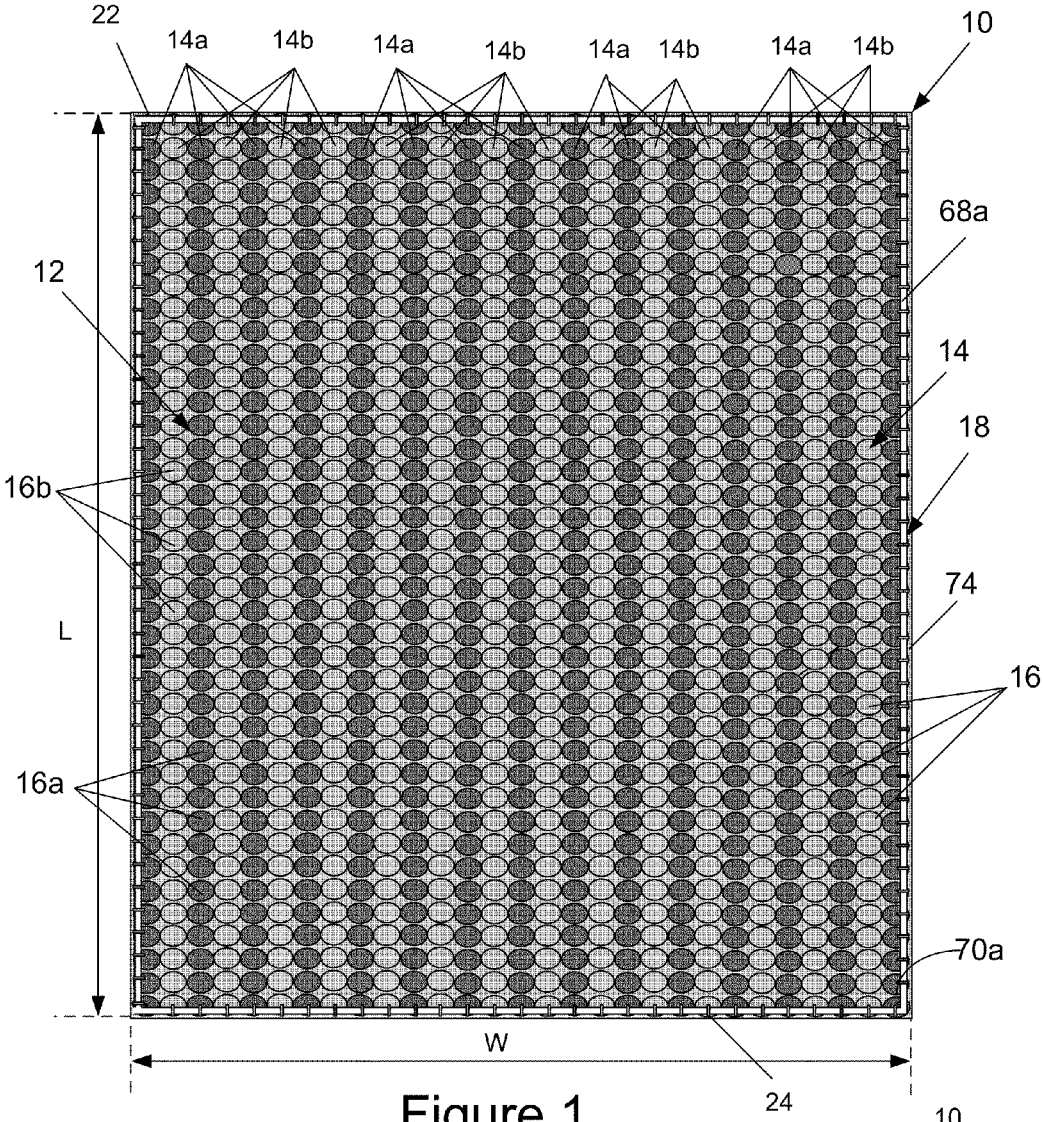
FIG. 1 is a plan view of a mattress core.
Figure 2:
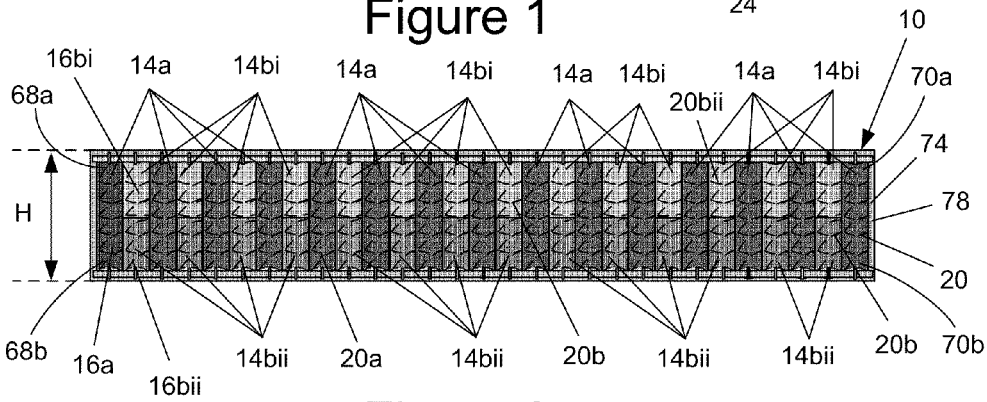
FIG. 2 is an end view of the mattress core shown in FIG. 1.

The mattress core 10 shown in FIGS. 1 and 2 has been developed with a view to providing better control of the firmness of mattresses. The below-described method of manufacturing the mattress core 10 provides the manufacturer with improved control over the firmness of the resultant mattress.

The mattress core 10 includes an array 12 of strings 14 of pocket springs 16 extending in parallel across the mattress core, and a fastener 18 coupling the array 12 of strings 14 of pocket springs 16 together. The array 12 of strings 14 of pocket springs 16 includes single strings 14*a* of pocket springs 16*a* and double strings 14*b* of pocket springs. Each double string 14*b* of the array 12 includes a superior string 14*bi* of pocket springs 16*bi* and an inferior string 14*bii* of pocket springs 16*bii*. Although the mattress core 10 is shown in one specific size and shape, many combinations of size and shape of the mattress core 10 fall within the scope of the invention.

The firmness of the mattress core 10 is controlled by selecting the rates of springs 20 of the pocket springs 16. Specifically, the manufacturer can exercise control of the firmness of the mattress that results from the mattress core 10 by selecting:

a. a rate of springs 20*a* for the single strings 14*a* of pocket springs 16*a;* b. a rate of springs 20*bii* for the superior strings 14*bi* of pocket springs 16*bi*; and c. a rate of springs 20*bii* for the inferior strings 14*bii* of pocket springs 16*bii.*

The rate of a spring is the change in the force it exerts, divided by the change in deflection of the spring. That is, it is the gradient of the force versus deflection curve.

The following combinations are possible for the mattress core 10:

1. Hard mattress core 10:

a. Hard-Hard:

i. Springs 20*a* for the single strings 14*a* of pocket springs 16*a* having a low rate; and ii. Springs 20*b* for the double strings 14*b* of pocket springs 16*b* having a low rate.

b. Hard-Medium I:

i. Springs 20*a* for the single strings 14*a* of pocket springs 16*a* having a low rate;

ii. Springs 20*bi* for the superior strings 14*bi* of pocket springs 16*bi* having a high rate; and ii. Springs 20*bii* for the inferior strings 14*bii* of pocket springs 16*bii* having a low rate.

c. Hard-Medium 11:

i. Springs 20*a* for the single strings 14*a* of pocket springs 16*a* having a low rate;

ii. Springs 20*bi* for the superior strings 14*bi* of pocket springs 16*bi* having a low rate; and ii. Springs 20*bii* for the inferior strings 14*bii* of pocket springs 16*bii* having a high rate.

d. Hard-Soft:

i. Springs 20*a* for the single strings 14*a* of pocket springs 16*a* having a low rate; and ii. Springs 20*b* for the double strings 14*b* of pocket springs 16*b* having a high rate.

2. Soft mattress core 10:

a. Soft-Soft:

i. Springs 20*a* for the single strings 14*a* of pocket springs 16*a* having a high rate; and ii. Springs 20*b* for the double strings 14*b* of pocket springs 16*b* having a high rate.

b. Soft-Medium I:

i. Springs 20*a* for the single strings 14*a* of pocket springs 16*a* having a high rate;

ii. Springs 20*bi* for the superior strings 14*bi* of pocket springs 16*bi* having a high rate; and ii. Springs 20*bii* for the inferior strings 14*bii* of pocket springs 16*bii* having a low rate.

c. Soft-Medium II:

i. Springs 20*a* for the single strings 14*a* of pocket springs 16*a* having a high rate;

ii. Springs 20*bi* for the superior strings 14*bi* of pocket springs 16*bi* having a low rate; and ii. Springs 20*bii* for the inferior strings 14*bii* of pocket springs 16*bii* having a high rate.

d. Soft-Hard:

i. Springs 20*a* for the single strings 14*a* of pocket springs 16*a* having a high rate; and ii. Springs 20*b* for the double strings 14*b* of pocket springs 16*b* having a low rate.

Further combinations could be introduced into the mattress core 10 by including springs 20*a*, 20*bi*, 20*bii* with greater variation than simply high or low rates.

A description of exemplary the method steps involve in manufacturing the mattress core 10 are set out below with reference to FIGS. 3 to 13.

1. Manufacture of Springs 20

Figure 3:
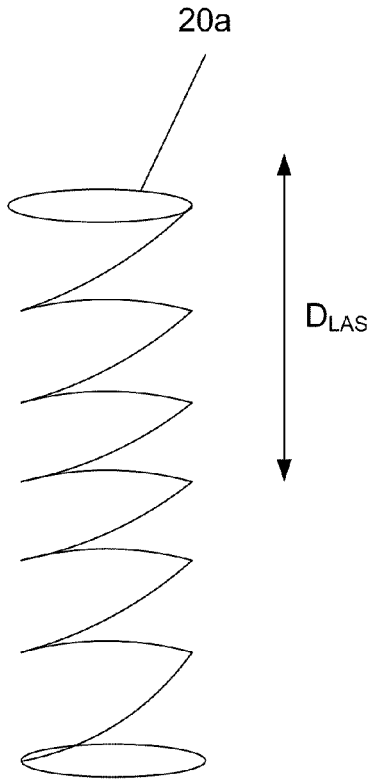
FIG. 3 is a side view of a spring of the mattress core shown in FIG. 1.
Figure 5:
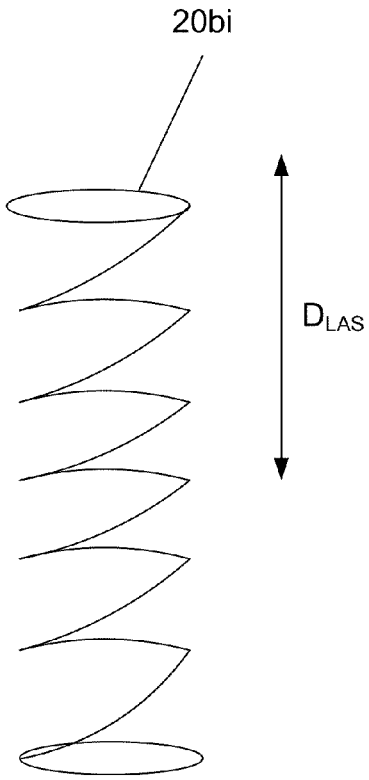
FIG. 5 is a side view of another spring of the mattress core shown in FIG. 1.
Figure 7:
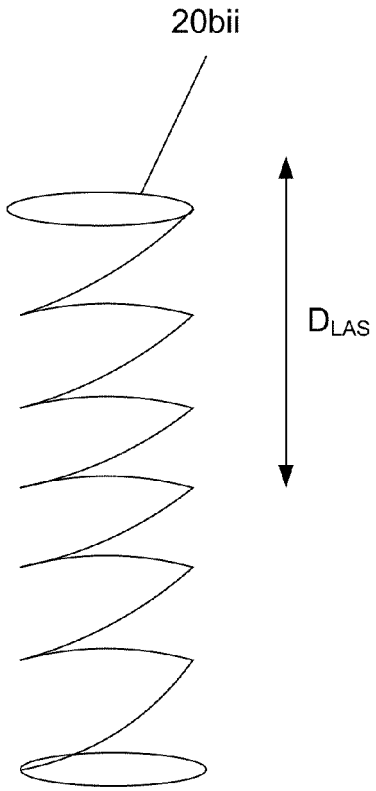
FIG. 7 is a side view of yet another spring of the mattress core shown in FIG. 1.

As particularly shown in FIGS. 3, 5 and 7, the springs 20*a*, 20*bi*, 20*bii* for the mattress core 10 are all preferably helical coils. The springs 20*a*, 20*bi*, 20*bii* formed using known apparatus (not shown) which takes a continuous length of metal wire and produces a helical coil. The apparatus produces coils having different rates for use in the different strings 14 of the mattress core 10. That is, the apparatus produces springs 20*a* for the single strings 14*a* of pocket springs 16*a*; springs 20*bi* for the superior strings 14*bi* of pocket springs 16*bi*; and springs 20*bii* the inferior strings 14*bii* of pocket strings 16*bii* having the following thickness:

a. Springs 20*a*=1 mm to 2.3 mm;

b. Springs 20*bi*=1 mm to 2.3 mm;

c. Springs 20*bii*=1 mm to 2.3 mm;

The manufacture exercises control over the firmness of the resultant mattress by making an appropriate selection of springs 20*a*, 20*bi*, 20*bii* for the mattress core 10.

2. Manufacture of Single Strings 14*a* of Pocket springs 16*a*

Figure 4A:
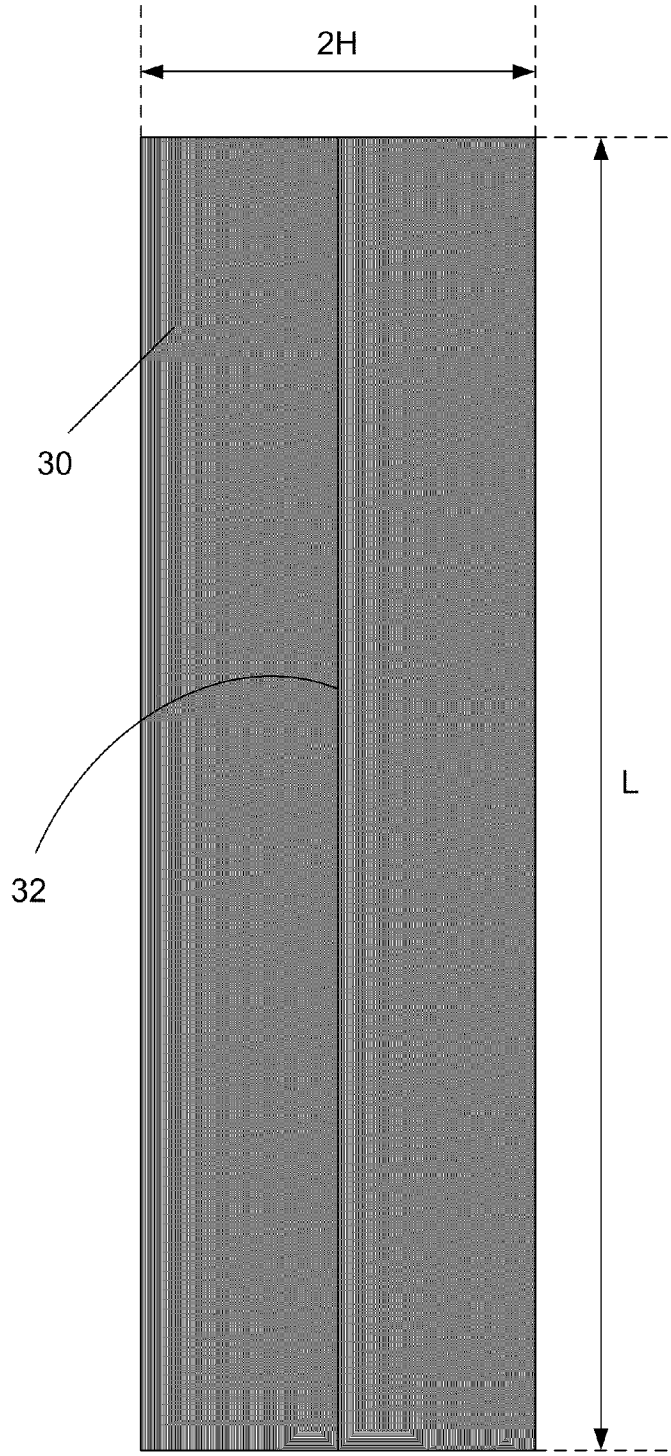
FIGS. 4*a* to 4*f* are plan views of a string of pocket springs the mattress core shown in FIG. 1 arranged in different stages of manufacture.

As particularly shown in FIG. 4*a*, fifteen sections 30 of material are cut, one for each for single string 14*a* of pocket springs 16*a*. Preferably, the material is non-woven. Alternatively, the material is cotton. Preferably, each section 30 of material has a length "L" and a height "2H".

Figure 4B:
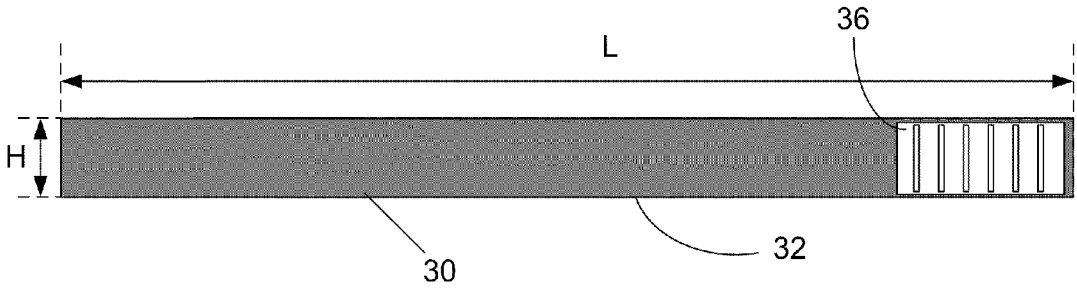
Figure 4C:
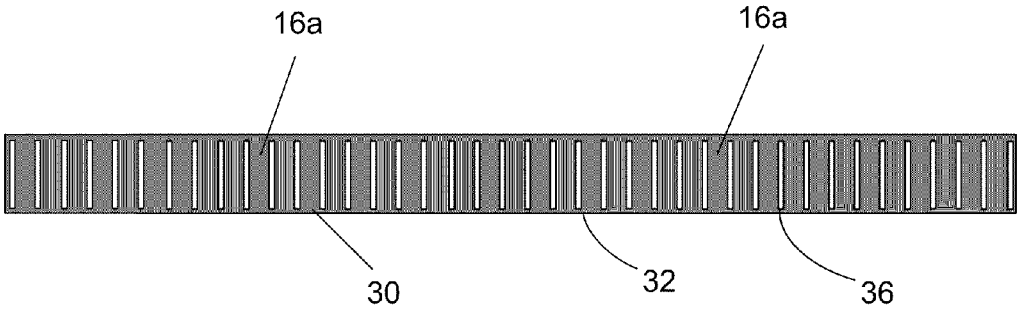

Each one of the fifteen sections 30 is folded in half along a lengthwise median crease 32 so that the top half overlies the bottom half in the manner shown in FIG. 4*b*. The top and bottom halves of the material 30 are then stitched together with spaced apart seams 34 in the manner shown in FIG. 4*c*. The seams 34 extend substantially perpendicularly to the direction of the above-mentioned crease, thereby creating pockets 16*a* for the springs 20*a*. As shown in FIGS. 4*b*, a template 36 is preferably used to indicate the seam positions.

Figure 4D:
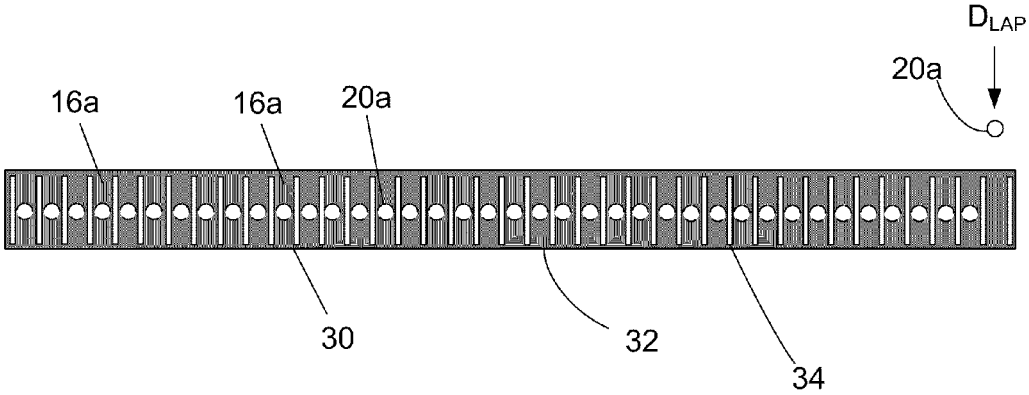

The springs 20*a* for the single strips 14*a* are then inserted into the pockets 16*a* of the material 30 in the manner shown in FIGS. 4*d*. Each spring 20*a* is arranged so that its longitudinal axis $D_{LAS}$ is perpendicular to the longitudinal axis $D_{LAP}$ of the pocket 16*a*.

Figure 4E:
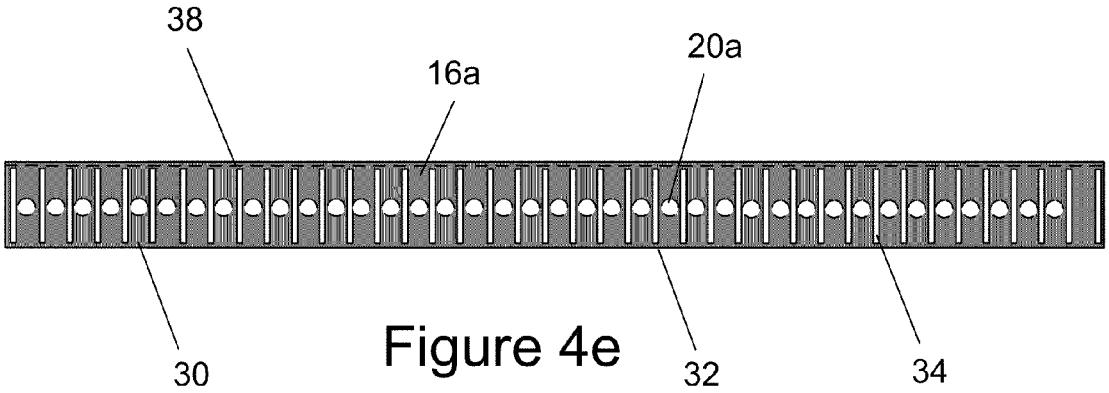
Figure 4F:
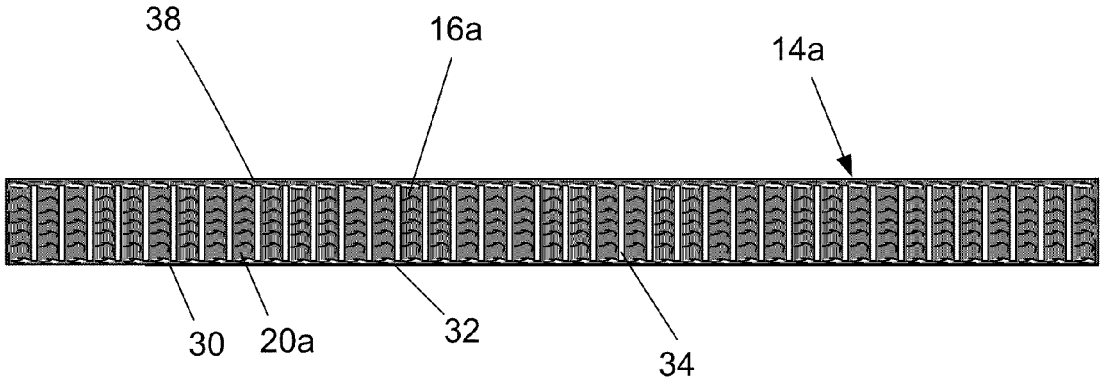

The top and bottom halves of each section 30 of material are then sewn together along a common seam 38, in the manner shown in FIG. 4*e*, so as to close the pockets 16. The springs 20*a* of each section 30 of material are then rotated in respective pockets 16*a* so that the longitudinal axes $D_{LAS}$ of the springs 20*a* are parallel to the longitudinal axes $D_{LAP}$ of the pockets 16*a*. In doing do the springs 20*a* resiliently expand within the pockets 16*a* in the manner shown in FIG. 4*f*.

3. Manufacture of Double Strings 14*b* of Pocket springs 16*b*

The manufacture of each double string 14*b* of pocket springs 16*b* involves the step of manufacturing a superior string 14*bi* of pocket springs 16*bi* and a corresponding inferior string 16*bii* of pocket springs 16*bii*. The steps involved in the manufacture of these strings 14*bi*, 14*bii* are described below.

3a. Manufacture of Superior String 14*bi* of Pocket Springs 16*bi*

Figure 6A:
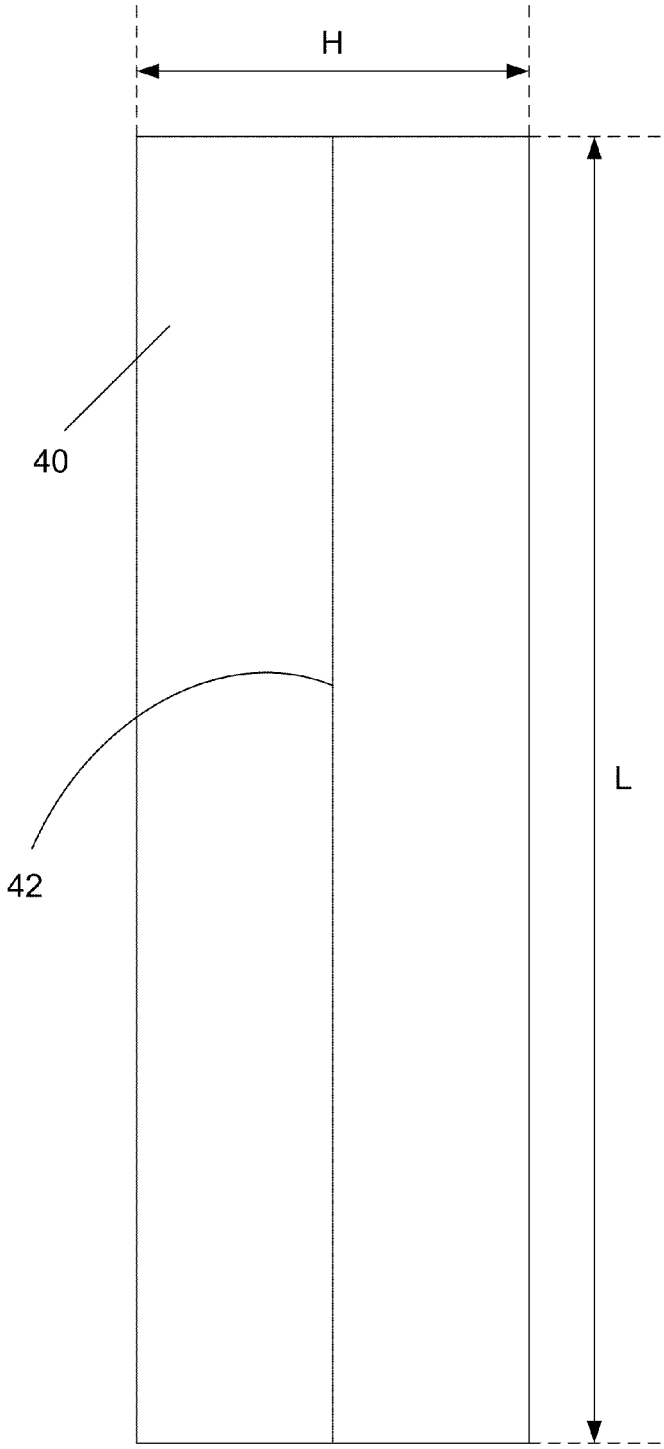
FIGS. 6*a* to 6*f* are plan views of another string of pocket springs the mattress core shown in FIG. 1 arranged in different stages of manufacture.

Fourteen sections 40 of material are cut, one for each for superior string 14*bi* of pocket springs 16*bi*, as shown in FIG. 6*a*. Preferably, the material is non-woven. Alternatively, the material is cotton. Preferably, each section 40 of material has a length "L" and a height "H".

Figure 6B:
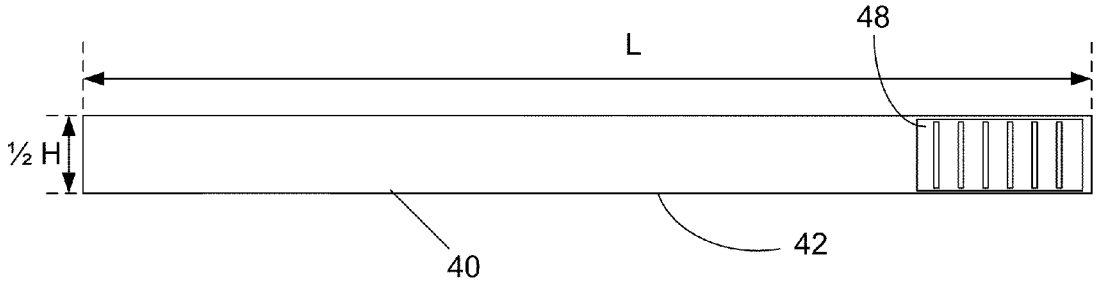
Figure 6C:
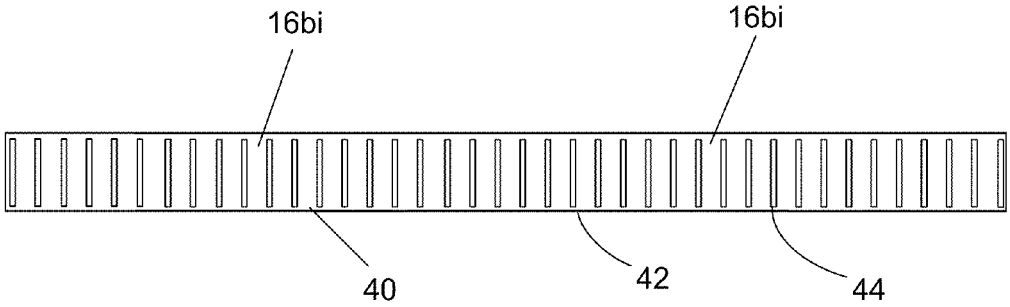

Each one of the fourteen sections 40 is folded in half along a lengthwise median crease 42 so that the top half overlies the bottom half in the manner shown in FIG. 6*b*. The top and bottom halves of the material 40 are then stitched together with spaced apart seams 44 in the manner shown in FIG. 6*c*. The seams 44 extend substantially perpendicularly to the direction of the above-mentioned crease, thereby creating pockets 16*bi* for the springs 20*bi*. As shown in FIGS. 6*b*, a template 46 is preferably used to indicate the seam positions.

Figure 6D:
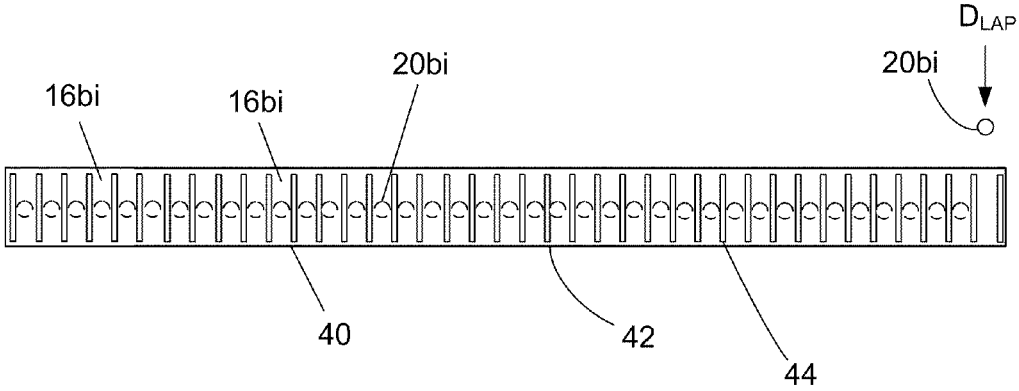

The springs 20*bi* for the superior strips 14*bi* are then inserted into the pockets 16*bi* of the material 40 in the manner shown in FIG. 6*d*. Each spring 20*bi* is arranged so that its longitudinal axis $D_{LAS}$ is perpendicular to the longitudinal axis $D_{LAP}$ of the pocket 16*bi*.

Figure 6E:
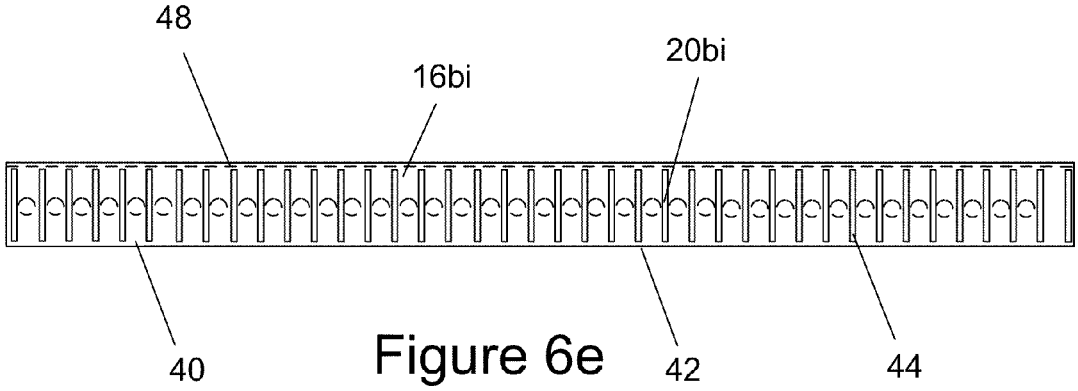
Figure 6F:
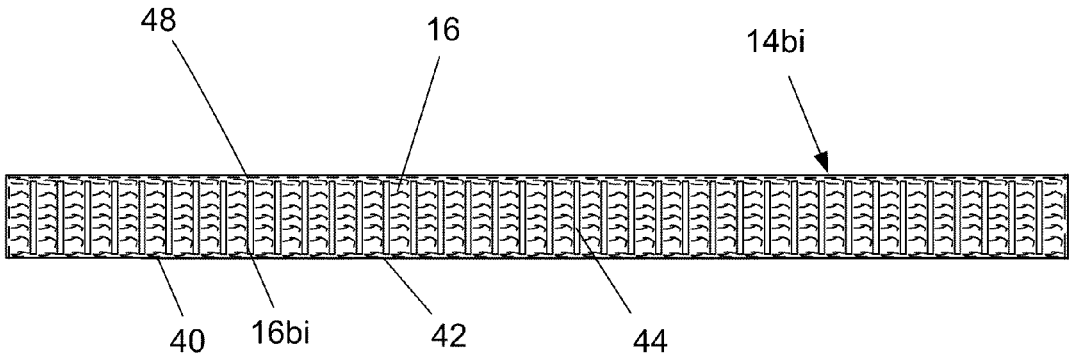

The top and bottom halves of each section 40 of material are then sewn together along a common seam 48, in the manner shown in FIG. 6*e*, so as to close the pockets 16*bi*. The springs 20*bi* of each section 40 of material are then rotated in respective pockets 16*bi* so that the longitudinal axes $D_{LAS}$ of the springs 20*bi* are parallel to the longitudinal axes $D_{LAP}$ of the pockets 16*bi*. In doing do the springs 20*bi* resiliently expand within the pockets 16*bi* in the manner shown in FIG. 6*f*.

3b. Manufacture of Inferior String 14*bii* of Pocket Springs 16*bii*

Figure 8A:
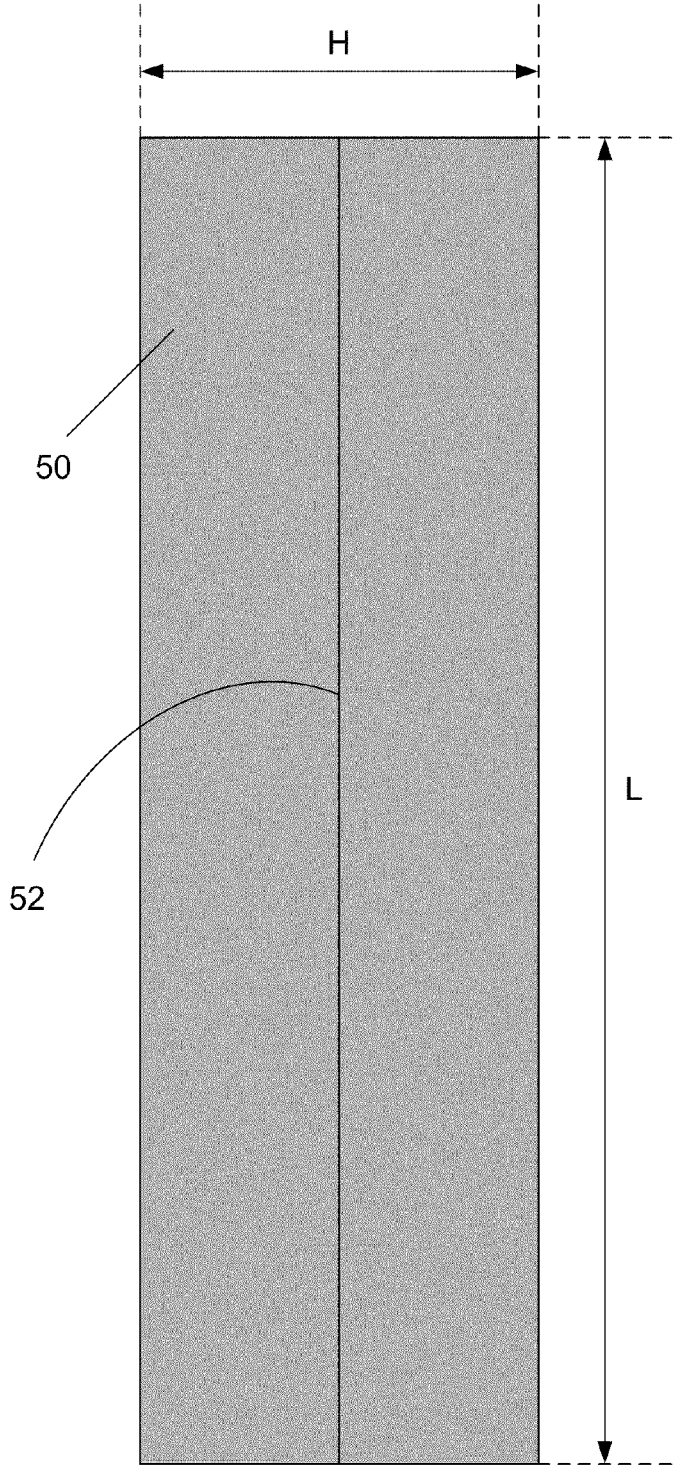
FIGS. 8*a* to 8*f* are plan views of yet another string of pocket springs of the mattress core shown in FIG. 1 arranged in different stages of manufacture.

Fourteen sections 50 of material are cut, one for each for superior string 14*bii* of pocket springs 16*bii*, as shown in FIG. 8*a*. Preferably, the material is non-woven. Alternatively, the material is cotton. Preferably, each section 50 of material has a length "L" and a height "H".

Figure 8B:
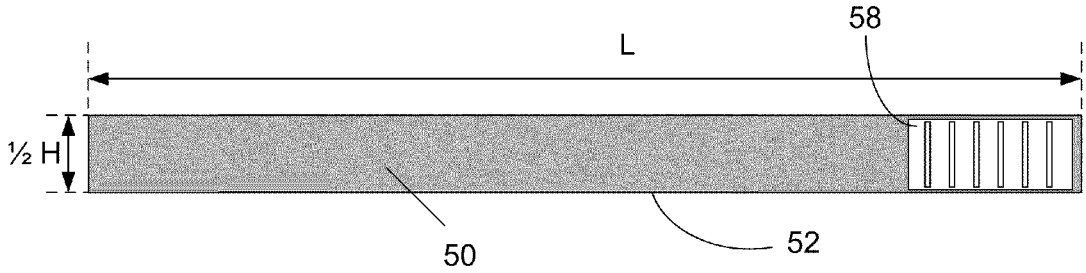
Figure 8C:
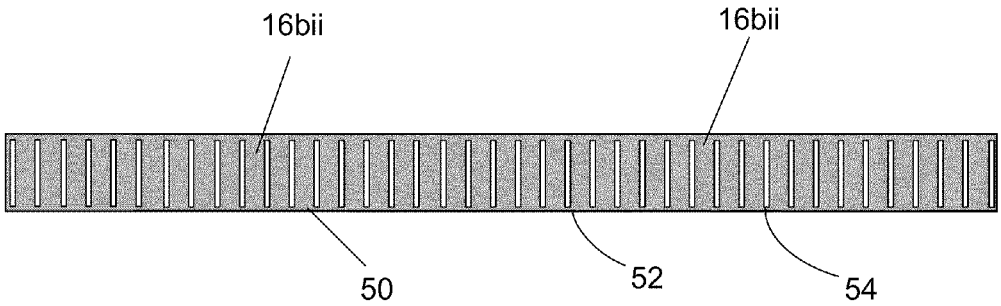

Each one of the fourteen sections 50 is folded in half along a lengthwise median crease 52 so that the top half overlies the bottom half in the manner shown in FIG. 8*b*. The top and bottom halves of the material 50 are then stitched together with spaced apart seams 54 in the manner shown in FIG. 6*c*. The seams 44 extend substantially perpendicularly to the direction of the above-mentioned crease, thereby creating pockets 16*bii* for the springs 20*bii*. As shown in FIG. 8*b*, a template 56 is preferably used to indicate the seam positions.

Figure 8D:
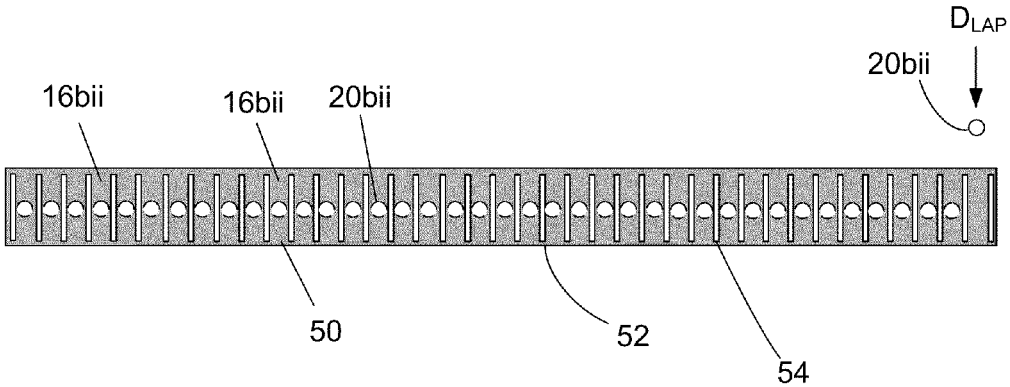

The springs 20*bii* for the superior strips 14*bii* are then inserted into the pockets 16*bii* of the material 50 in the manner shown in FIG. 8*d*. Each spring 20*bii* is arranged so that its longitudinal axis $D_{LAS}$ is perpendicular to the longitudinal axis $D_{LAP}$ of the pocket 16*bii*.

Figure 8E:
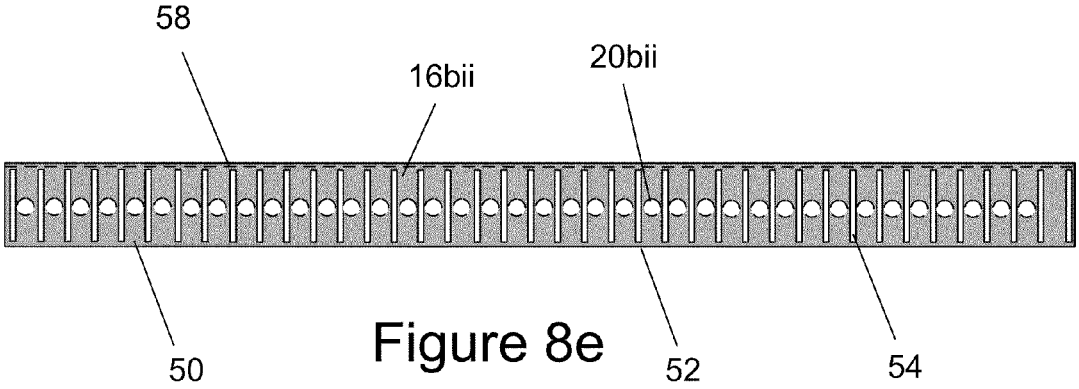
Figure 8F:
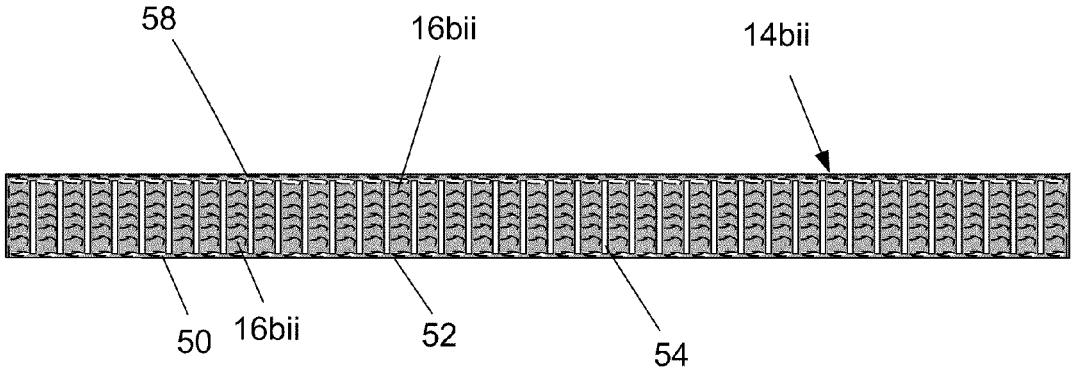
Figure 9A:
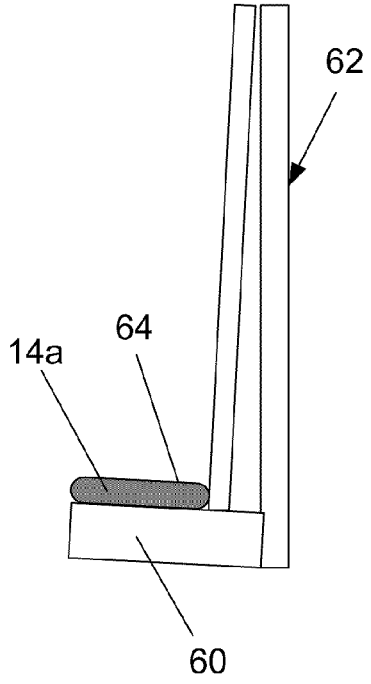
FIGS. 9*a* to 9*d* are side views of a mattress core construction frame with stings of the mattress core shown in FIG. 1 assembled thereon.
Figure 9B:
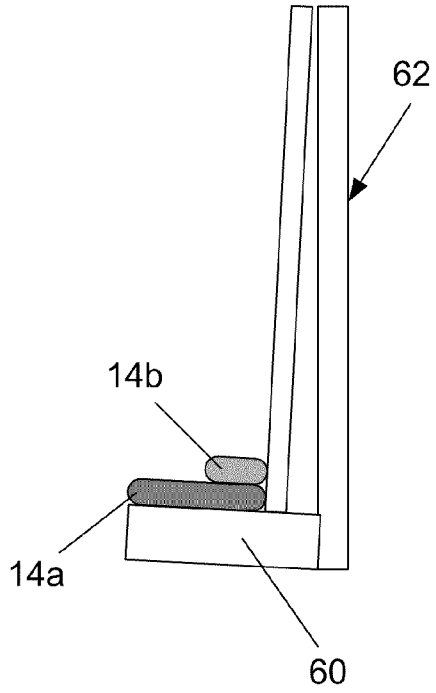
Figure 9C:
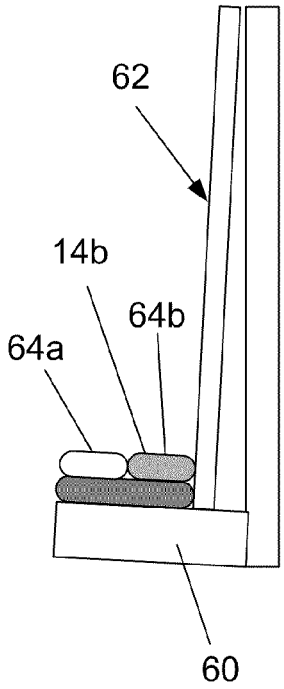
Figure 9D:
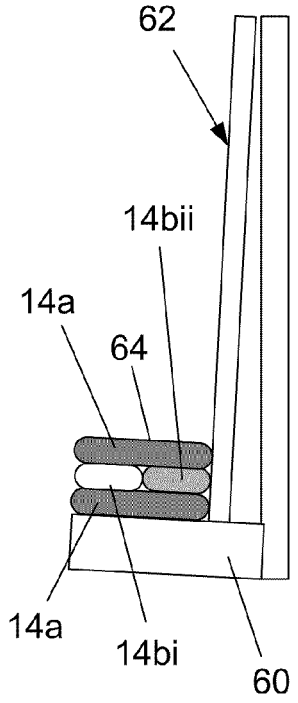

The top and bottom halves of each section 50 of material are then sewn together along a common seam 58, in the manner shown in FIG. 8*e*, so as to close the pockets 16*bii*. The springs 20*bii* of each section 50 of material are then rotated in respective pockets 16*bii* so that the longitudinal axes $D_{LAS}$ of the springs 20*bi* are parallel to the longitudinal axes $D_{LAP}$ of the pockets 16*bii*. In doing do the springs 20*bii* resiliently expand within the pockets 16*bii* in the manner shown in FIG. 8*f*.

4. Manufacture of the Array 12 of Strings 14 of Pocket Springs 16

Figure 10:
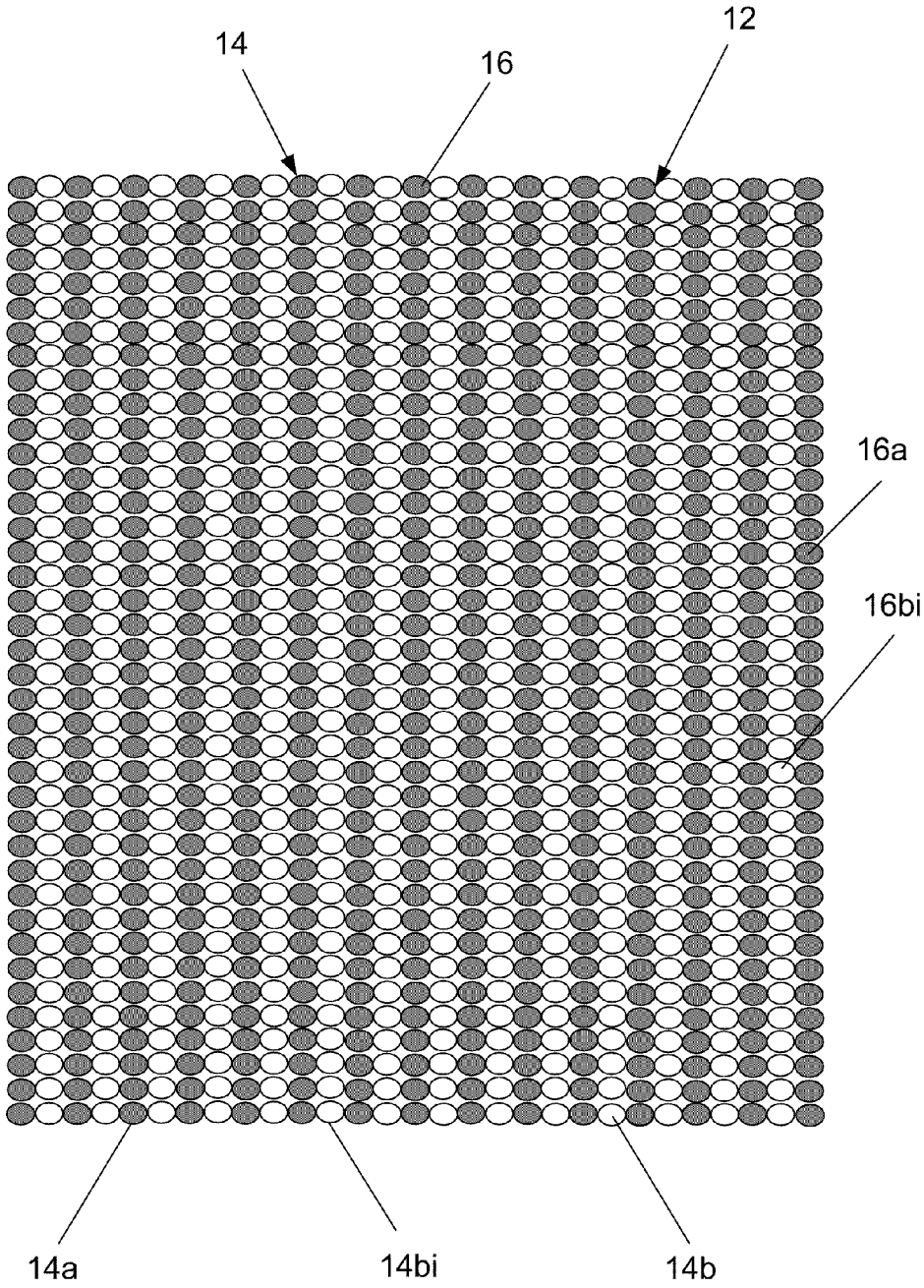
FIG. 10 is a plan view of two halves of an array of pocket springs of the mattress core shown in FIG. 1.

Once all of the strings 14 have been manufactured the array 12 of strings 14 of pocket springs 16, the steps shown in FIGS. 9*a* to 9*d* are performed to manufacture the assay 12 shown in FIG. 10. These steps are described below.

a. Arranging the first single string 14*a* of pocket springs 16*a* along a footing 60 of a mattress core construction frame 62 in the manner shown in FIG. 9*a;* b. Applying an adhesive to the superior articular side 64 of each pocket spring 16*a* of the first single string 14*a* of pocket springs 16*a;* c. Arranging an inferior string 14*bii* of pocket springs 16*bii* over the previous single string 14*a* of pocket springs 16*a*, in the manner shown in FIG. 9*b;* d. Arranging a superior string 14*bi* of pocket springs 16*bi* over the previous single string 14*a* of pocket springs 16*a*, in the manner shown in FIG. 9*c;* e. Applying an adhesive to the superior articular sides 64*a*, 64*b* of each pocket spring 16*bi*, 16*bii* of the superior and inferior strings 14*bi*, 14*bii* of pocket springs 16*bi*, 16*bii*; and f. Arranging a single string 14*a* of pocket springs 16*a* over the superior and inferior strings 14*bi*, 16*bii* of pocket springs 16*bi*, 16*bii* in the manner shown in FIG. 9*d;* g. Repeating steps c and f until all strings 14 have been coupled together.

The adhesive is preferably a hot melt glue. Alternatively, any suitable adhesive could be used. The adhesive is preferably applies using a glue gun.

Figure 11:
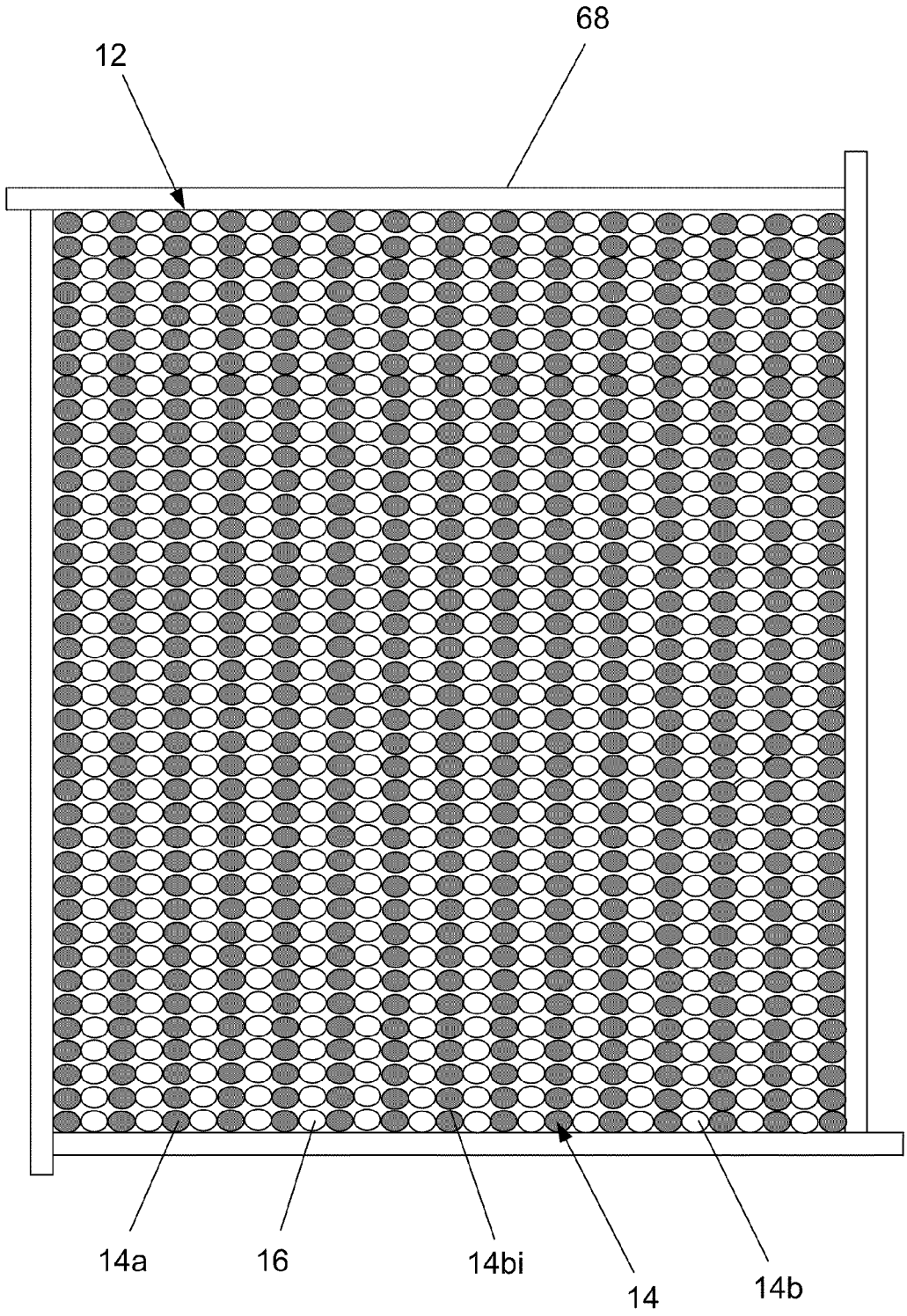
FIG. 11 is a plan view of the two halves of the array of pocket springs shown in FIG. 10 framed in a box.

The array 12 of pocket springs 16 are then framed in a box 66 in the manner shown in FIG. 11. The box 66 is of suitable size and shape to fit around the periphery of the array 12 in the manner shown. The box 66 exerts a compressive force on the array 12.

Once arranged in the box 66, the fastener 18 is used to couple the array 14 of pocket springs 16 together. The fastener 18 includes upper and lower rectangular peripheral borders 68*a*, 68*b* are arranged around the upper and lower peripheral edges 70*a*, 70*b* of pocket springs 16 of the array 12 in the manner shown in FIG. 11. The borders 68*a*, 68*b* are preferably made of metal. Alternatively, the borders are made of plastic. The upper and lower borders 68*a*, 68*b* are coupled to upper and lower sections of springs 20 of the peripheral pocket springs 16 with fasteners 72. The fasteners 72 are preferably metal couplings.

Figure 12:
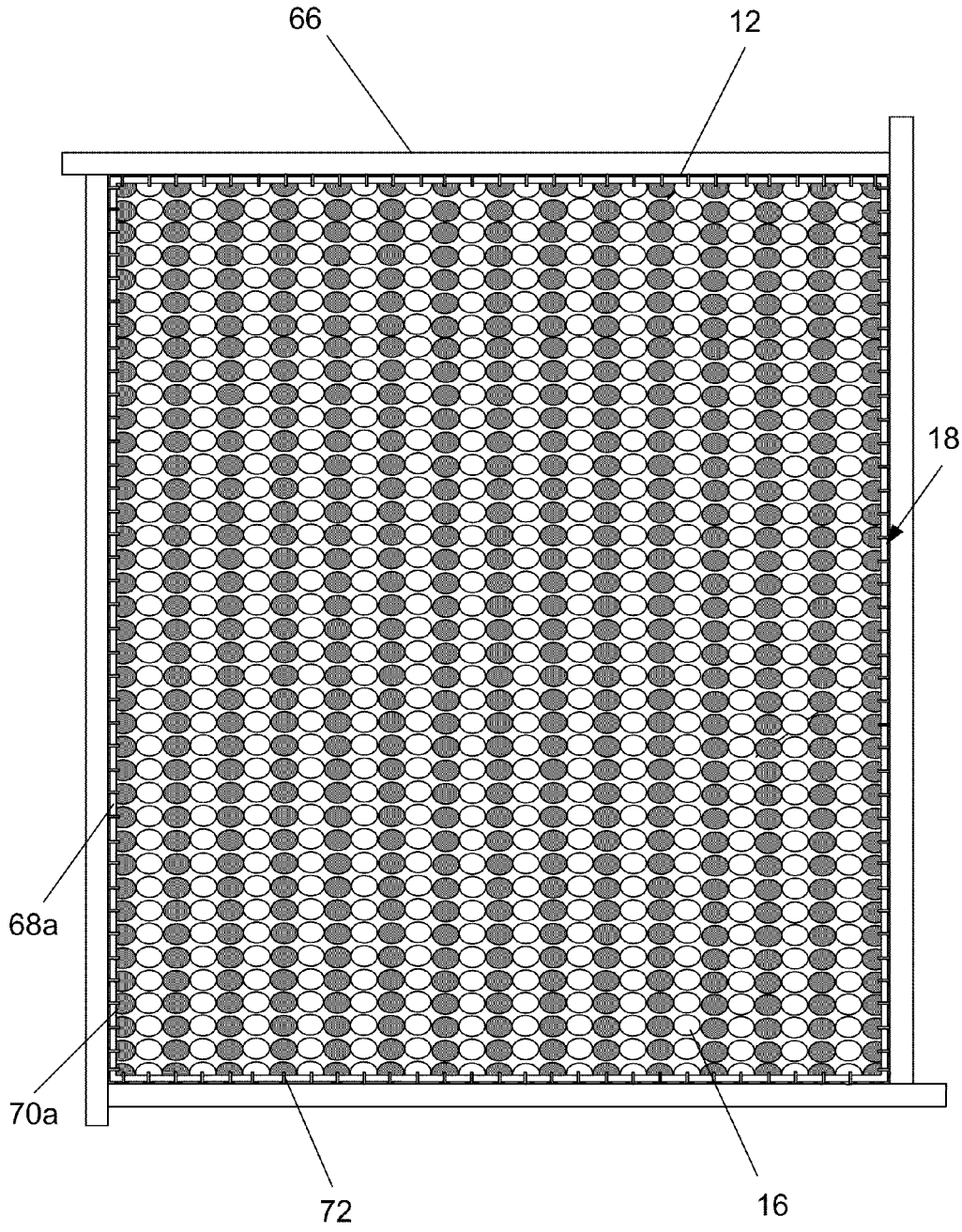
FIG. 12 is a plan view of the two halves of the array of pocket springs shown in FIG. 10 arranged in another condition of manufacture.
Figure 13:
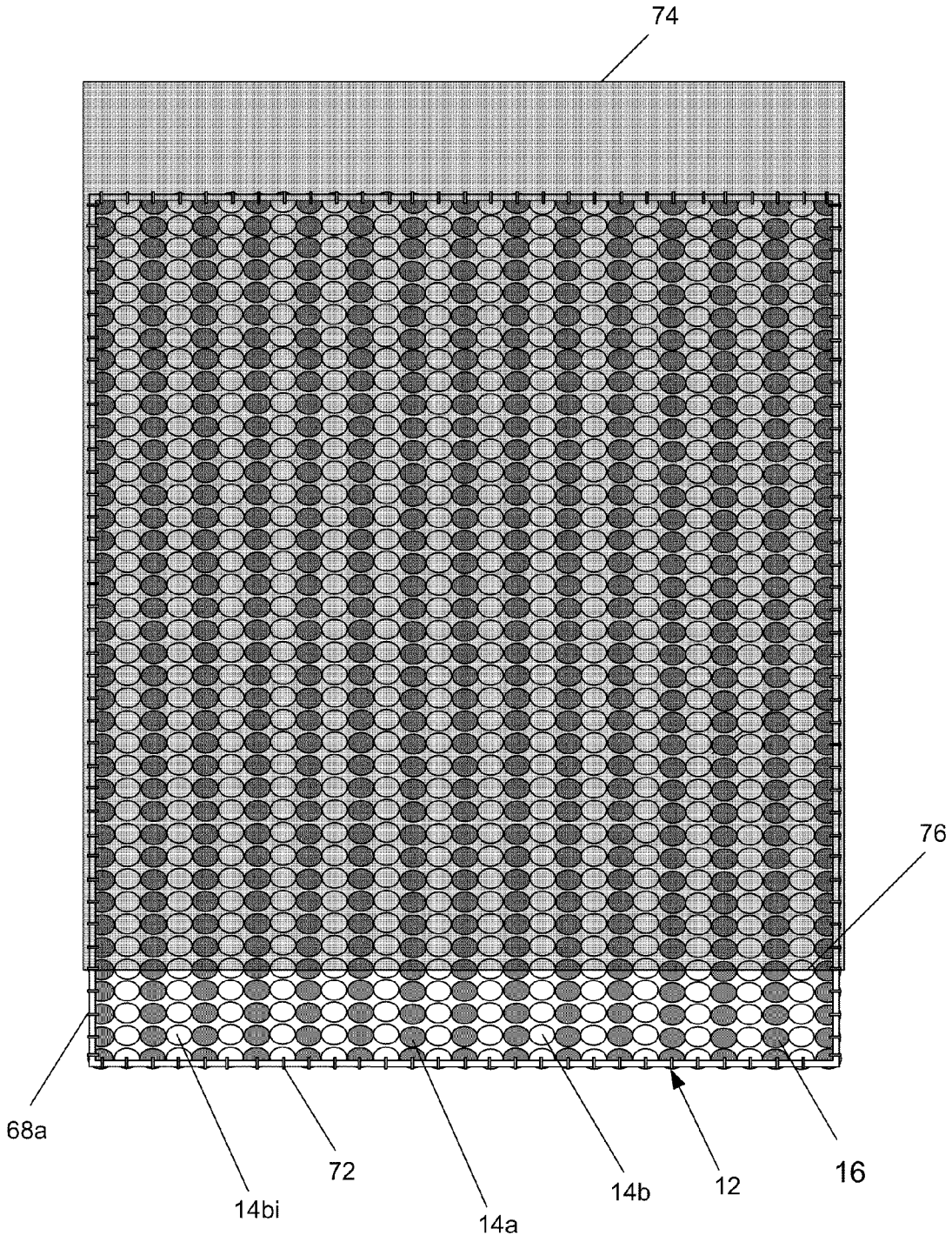
FIG. 13 is a plan view of the mattress core shown in FIG. 1 arranged in a condition of manufacture.

The box 66 is then removed and a mesh cover 74 is then pulled over the array 12 in the manner shown in FIG. 12. Preferably, the mesh cover 74 has the shape of a rectangular cuboid and is open at one of the short ends 76. A short end of the array 12 is inserted through the open end 76 of the mesh cover 74. The cover 74 is then pulled down until the open end 76 is proximal the other short end of the array 12.

The open end 76 of the cover 74 includes a flap 78 which is shaped to stretch over the short end of the array 12 so as to close the open end 76 of the cover 74 in the manner shown in FIG. 2.

Advantageously, the mattress core has the following dimensions:

L=210 cm

W=200 cm

H=12 to 30 cm

Alternatively, any other suitable length (L), width (W), and height (H) could be used.

Although the mattress core 10 is described by way of reference to the configuration shown in FIGS. 1 and 2 having fifteen single strings 14*a* of pocket springs 16*a* and fourteen double strings 14*b* of pocket springs 16*b*, the mattress core 10 can include any other suitable configuration of single strings 14*a* of pocket springs 16*a* and double strings 14*b* of pocket springs 16*b*. For example, the mattress core 10 may include single strings 14*a* of pocket springs 16*a* that are separated by side-by-side pairs of double strings 14*b* of pocket springs 16*b*. Alternatively, the mattress core 10 may include double strings 14*b* of pocket springs 16*b* that are separated by side-by-side pairs of single strings 14*a* of pocket springs 16*a*.

The description of the mattress core 10 provided has been provided with reference to the strings 14 extending between a head 22 and foot 24 of the mattress core 10. However, the strings 14 could, alternatively, extend across the mattress core 10.

Although the mattress core has been described with reference to manufacturing strings 14 of pocket springs 16 using stitching techniques, any other suitable techniques for manufacturing strings 14 of pocket springs 16 can alternatively be used. For example, the techniques taught by U.S. Pat. No. 4,234,983 can be used to manufacture the strings 14 of pocket springs 16.

In an alternative embodiment, the mattress core 10 includes strings of double strings of pocket springs only.

Many modifications will be apparent to those skilled in the art without departing from the scope of the present invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

Claims defining the invention:

1. A mattress core including:

(a) an array of strings of pocket springs extending in parallel across the mattress core; and (b) a fastener coupling the array of strings of pocket springs together, wherein said array of strings of pocket springs includes single strings of pocket springs and double strings of pocket springs, each double string of said double strings of pocket springs including a superior string of pocket springs mounted over an inferior string of pocket springs, wherein each double string of said double strings is arranged between a corresponding pair of said single strings of pocket springs, and wherein each superior string of pocket springs is coupled to a corresponding inferior string of pocket springs by another fastener.

2. The mattress core claimed in claim 1, wherein springs of each of the single strings of pocket springs have a common first rate, springs of each superior string of pocket springs have a common second rate, and springs of each inferior string of pocket springs have a common third rate.

3. The mattress core claimed in claim 2, wherein the first rate is less than the second rate, and the first rate is less than third rate.

4. The mattress core claimed in claim 2, wherein the third rate is less than the second rate.

5. The mattress core claimed in claim 1, wherein pairs of said double strings are arranged between corresponding pairs of said single strings of pocket springs.

6. The mattress core claimed in claim 1, wherein the strings of pocket springs extend between a head and foot of the mattress core.

7. The mattress core claimed in claim 1, wherein opposed articular surfaces of pocket springs in opposed strings of pocket springs are coupled together with an adhesive.

8. The mattress core claimed in claim 1, including top and bottom rectangular peripheral bands respectively coupled to top and bottom sections of peripheral pocket springs of the array.

9. The mattress core claimed in claim 8, wherein the top and bottom rectangular peripheral bands are respectively coupled to top and bottom sections of peripheral pocket springs with clips.

10. A mattress including the mattress core claimed in claim 1.

11. A method of manufacturing a mattress core including the steps of:

(a) coupling a series of strings of pocket springs together with a fastener to form an array of strings of pocket springs; and (b) coupling the array of strings of pocket springs together with a fastener, wherein said array of strings of pocket springs includes single strings of pocket springs and double strings of pocket springs, each double string of said double strings of pocket springs including a superior string of pocket springs mounted over an inferior string of pocket springs, wherein each double string of said double strings is arranged between a corresponding pair of said single strings of pocket springs, and wherein each superior string of pocket springs is coupled to a corresponding inferior string of pocket springs by another fastener.

12. The method claimed in claim 11, including the step of selecting a rate of springs of each superior string of pocket springs.

13. The method claimed in claim 11, including the step of selecting a rate of springs of each inferior string of pocket springs.

14. The method claimed in claim 11, including the step of selecting a rate of springs of each single string of said single strings of pocket springs.

15. The method claimed in claim 11, wherein pairs of said double strings are arranged between corresponding pairs of said single strings of pocket springs.

16. The method claimed in claim 11, wherein the strings of pocket springs extend between a head and foot of the mattress core.

17. The method claimed in claim 11, wherein the step of coupling include the step of coupling articular surfaces of pocket springs in opposed strings of pocket springs are coupled together with an adhesive.

18. The method claimed in claim 11, wherein the step of coupling include the step of coupling top and bottom rectangular peripheral bands respectively to top and bottom sections of peripheral pocket springs of the array.

19. The method claimed in claim 18, wherein the top and bottom rectangular peripheral bands are respectively coupled to top and bottom sections of peripheral pocket springs with clips.

* * * * *